US008007419B2

(12) United States Patent
Dieter et al.

(10) Patent No.: US 8,007,419 B2
(45) **Date of Patent: *Aug. 30, 2011**

(54) OVERSPEED TRAINER SYSTEM

(75) Inventors: William Dieter, Portland, OR (US); Patricia Eiting, Portland, OR (US); Polly James, Oconomowoc, WI (US)

(73) Assignee: Nike, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/722,424

(22) Filed: Mar. 11, 2010

(65) Prior Publication Data

US 2010/0279831 A1 Nov. 4, 2010

Related U.S. Application Data

(63) Continuation of application No. 11/647,556, filed on Dec. 27, 2006, now Pat. No. 7,699,761.

(60) Provisional application No. 60/755,273, filed on Dec. 29, 2005.

(51) Int. Cl.

| | |
|---|---|
| ***A63B 21/02*** | (2006.01) |
| ***A63B 3/00*** | (2006.01) |
| ***A63B 71/00*** | (2006.01) |
| ***A63B 21/002*** | (2006.01) |

(52) U.S. Cl. ..... 482/124; 482/14; 482/74; 482/91

(58) Field of Classification Search ..... 482/14, 482/74, 91, 122, 124, 139, 906; 473/422, 473/424, 464; 434/253; 119/769, 770, 772, 119/776, 778, 792, 795

See application file for complete search history.

(56) References Cited

U.S. PATENT DOCUMENTS

| | | | | |
|---|---|---|---|---|
| 3,099,250 | A * | 7/1963 | Soles, Jr. | 119/776 |
| 3,519,269 | A * | 7/1970 | Howlett et al. | 482/120 |
| 3,540,089 | A * | 11/1970 | Franklin | 24/602 |
| 3,910,234 | A * | 10/1975 | Henson | 119/774 |
| 4,404,927 | A * | 9/1983 | Woutat | 119/776 |
| 4,544,155 | A | 10/1985 | Wallenbrook et al. | |
| 5,125,365 | A | 6/1992 | Bonilla | |
| 5,167,601 | A * | 12/1992 | Frappier | 482/121 |
| RE34,351 | E * | 8/1993 | Lacey | 119/776 |
| 5,718,189 | A * | 2/1998 | Blake | 119/770 |
| 5,803,881 | A * | 9/1998 | Miller | 482/124 |
| 5,813,955 | A | 9/1998 | Gutkowski et al. | |
| D399,702 | S | 10/1998 | Mishan | |
| 5,951,443 | A * | 9/1999 | Askins | 482/74 |
| 5,993,362 | A | 11/1999 | Ghobadi | |
| 6,082,308 | A | 7/2000 | Walter | |
| 6,374,779 | B1 * | 4/2002 | Miller | 119/863 |
| 6,629,511 | B2 | 10/2003 | De Bien | |
| 7,699,761 | B1 * | 4/2010 | Dieter et al. | 482/124 |
| 2003/0145801 | A1 * | 8/2003 | DeBien | 119/772 |

* cited by examiner

*Primary Examiner* — Allana Lewin
(74) *Attorney, Agent, or Firm* — Banner & Witcoff Ltd.

(57) ABSTRACT

A single-handed overspeed trainer system that detachably tethers an athlete to a trainer through a substantially quiet, non-hook and loop material, release structure is disclosed. In one embodiment, the athlete wears a belt with a substantially rigid loop extending therefrom. The trainer holds one end of a tether that contains a retractable pin toward its opposite end. The pin holds the rigid loop of the belt until the pin is retracted by the trainer, preferably when the tether's handle is released by the trainer.

19 Claims, 4 Drawing Sheets

OVERSPEED TRAINER SYSTEM

CROSS-REFERENCE TO RELATED APPLICATION

This application is a continuation and claims priority to U.S. patent application Ser. No. 11,647,556 filed on Dec. 27, 2006, which application claims priority to U.S. provisional patent application Ser. No. 60/755,273, filed on Dec. 29, 2005. Both applications are hereby entirely incorporated by reference.

FIELD OF THE INVENTION

The present invention relates to an overspeed trainer system for use primarily to detachably tether an athlete to a trainer.

BACKGROUND OF THE INVENTION

Overspeed trainers are used by athletes to improve their quickness and strength. Exemplar overspeed trainers can be found in U.S. Pat. No. 5,951,443 to Askins, and U.S. Pat. No. 5,803,881 to Miller, the disclosures of which are hereby incorporated by reference.

Despite the benefits offered by these known overspeed trainers, they have several drawbacks. For example, the person holding the tether must use both hands to activate their release mechanisms. Also, these known release mechanisms usually are quite noisy and frequently force the athlete to retain a "tail" portion of the tether. Such a tail is undesirable because it can catch on items or become entangled in the athlete's legs during training.

SUMMARY OF THE INVENTION

Accordingly, despite the available overspeed trainers, there remains a need for a single-handed overspeed trainer system that detachably tethers an athlete to another person.

The overspeed trainer of the present invention also includes a tether detachment structure that quietly activates, thereby preventing an athlete from using the sound of the releasing structure to anticipate release from the tether. Also, no "tail" portion remains with the athlete following detachment from the tether.

In addition to the other benefits disclosed herein, the present invention fulfills these needs.

DETAILED DESCRIPTION OF PREFERRED EMBODIMENTS

Figure 1A:
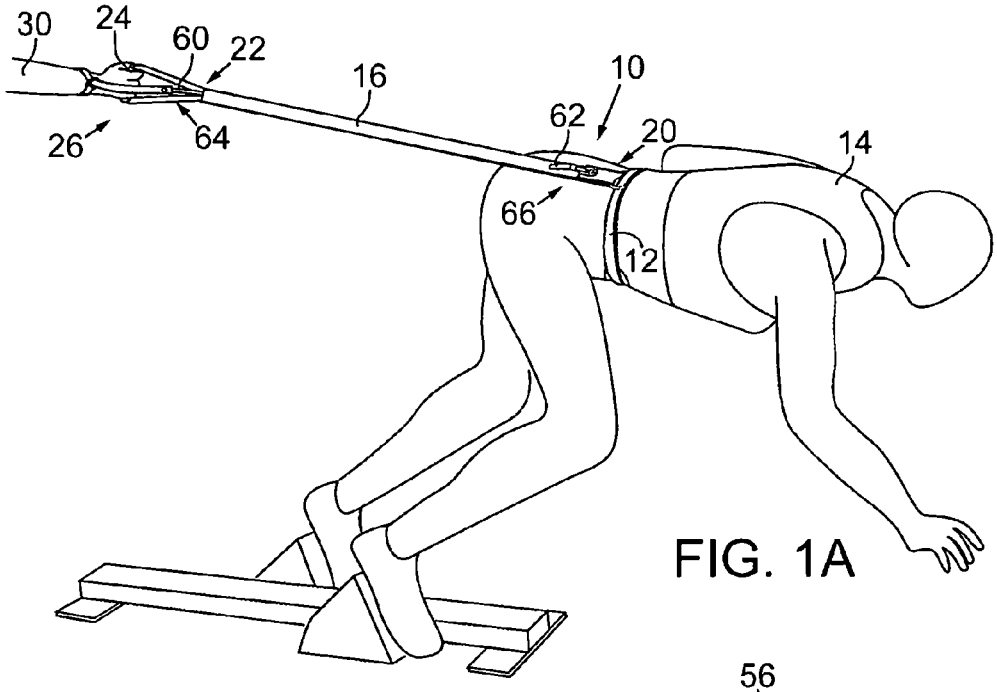
FIG. 1A is an isometric view of an overspeed trainer in accordance with an embodiment of the present invention showing a possible use configuration tethering an athlete to a trainer's hand.

An overspeed training system 10 is disclosed in FIGS. 1A-8. The overspeed training system 10 has an adjustable belt 12 that is worn by the athlete 14 and an elongate tether 16 is secured to the belt 12 at a first end 20 of the tether 16. The opposite second end 22 of the tether 16 preferably includes a handle 24. A release mechanism 26 operably secured to the tether 16 and belt 12, detachably secures the tether 16 to the belt 12.

A second person 30 holds the handle 24 while the athlete 14 pulls against the tether 16 as shown in FIG. 1A. During training exercises, the second person 30 activates the release mechanism 26 when the athlete 14 is pulling against the tether 16, thereby detaching the athlete 14 from the tether 16.

Figure 5:
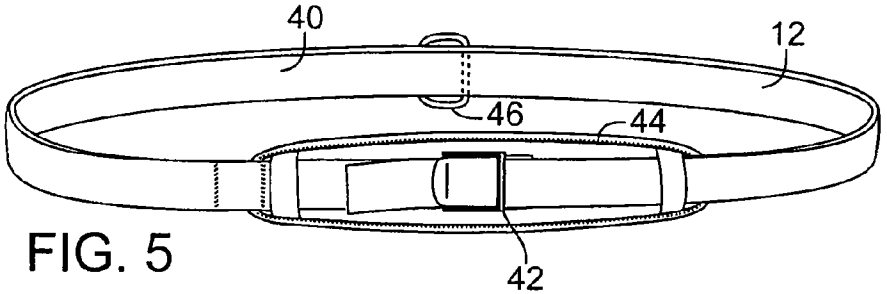
FIG. 5 is a front view of a belt portion forming a part of the overspeed trainer of FIG. 1.
Figure 6:
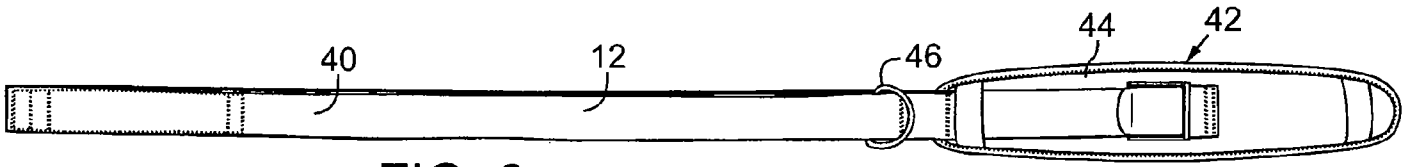
FIG. 6 is the belt portion in a possible disconnected configuration.
Figure 7:
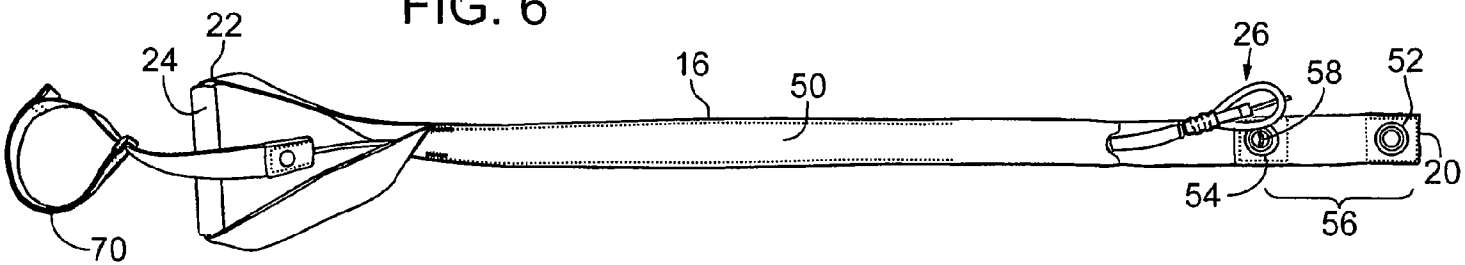
FIG. 7 is a top view of a tether portion forming a part of the overspeed trainer of FIG. 1.
Figure 8:
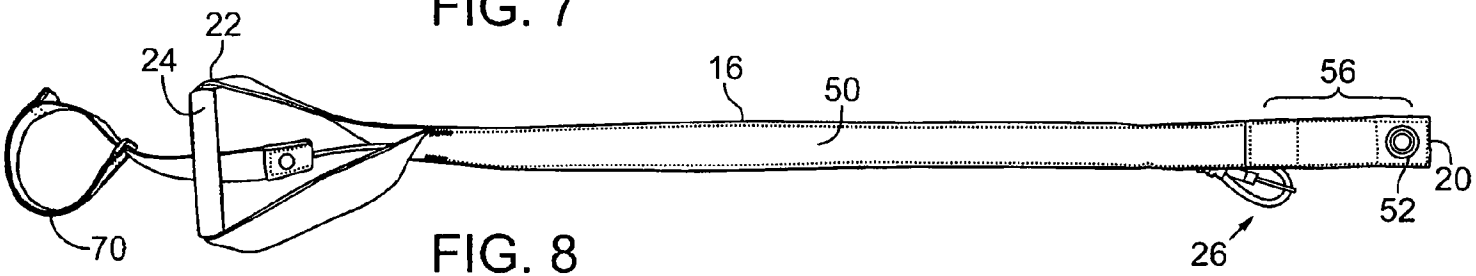
FIG. 8 is a back view of the tether portion of FIG. 7.

Referring to FIGS. 5 & 6, the belt 12 is preferably an elongate band of material 40 that is sized to encircle the athlete's waist. A belt buckle 42 is preferably provided to allow the size of the belt 12 to be adjusted on the athlete 14. More preferably, a pad 44 is operably secured to the belt 12 to improve the belt's comfort during use of the overspeed training system 10. A D-ring 46 is slidably secured to the belt 12 as shown.

Figure 2A:
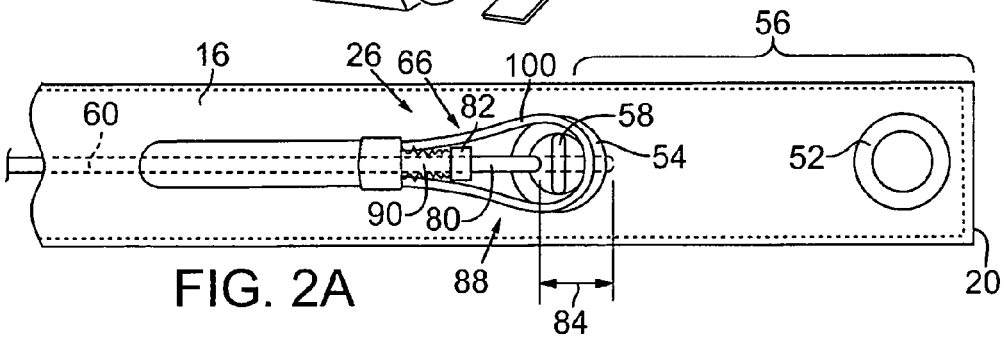
FIG. 2A is a partial top view of the overspeed trainer of FIG. 1 showing a release pin in a possible disengaged position.

The tether 16 preferably includes an elongate band of substantially flexible, but durable, material 50 such as woven material or the like. As best shown in FIG. 2A, a first grommet 52 is preferably positioned toward the first end 20 of the tether 16, and a second grommet 54 is spaced apart from the first grommet 52. Both grommets 52, 54 are substantially aligned along the longitudinal length of the tether 16, thereby defining a flap portion 56 of the tether 16, between the two grommets 52, 54. The second grommet 54 preferably includes a substantially rigid loop 58 extending substantially perpendicularly from the second grommet 54.

The release mechanism 26 is preferably a cable release as best shown in FIGS. 1A-2B. A cable 60 is slidably received within a cable housing 62, which is secured within the tether 16 as shown. One end of the cable is positioned substantially adjacent to the handle 24, thereby defining a handle-end 64 of the cable 60, and the opposite end of the cable 60 is positioned substantially adjacent to the second grommet 54 on the tether 16, thereby defining a grommet-end 66 of the cable 60.

A wrist strap 70 is preferably operably secured to the cable 60 at the handle-end 64 of the cable 60. The wrist strap 70 is preferably secured to the second person's wrist of the hand that is holding the handle 24 of the tether 16 as shown in FIG. 1A.

Figure 2B:
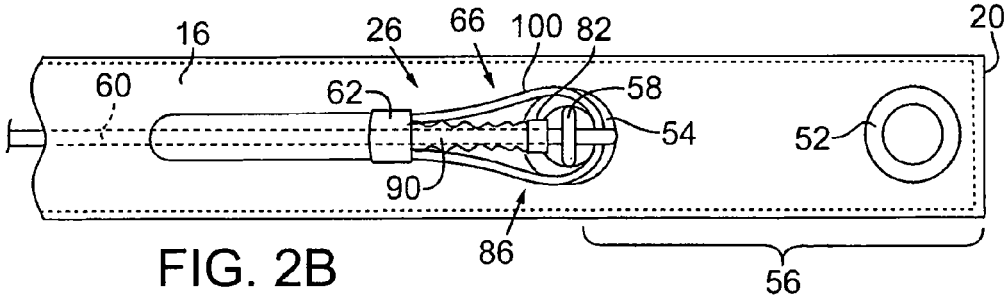
FIG. 2B is a partial top view of the overspeed trainer of FIG. 1 showing a release pin in a possible engaged position.

The grommet-end 66 of the cable 60 is sized and positioned so as to allow the distal end of the cable, which is referred to as a pin 80, to extend through the substantially rigid loop 58 as best showing FIGS. 2A & 2B. A ferrule 82 is secured to the cable 60 to limit the range of movement of the cable 60 to a defined distance 84 (FIG. 2A). This defined distance 84 includes an engaged position 86 (FIG. 2B) wherein the pin 80 extends through the substantially rigid loop 58, and a disengaged position 88, wherein the pin 80 is disengaged from the substantially rigid loop 58 as shown in FIG. 2A.

Preferably, a biasing member 90, such as a spring or other resilient member urges the pin toward the engaged position 86. More preferably, the biasing member 90 provides about 14 to 20 pounds of resistive force when compressed. Also, a protective loop 100 of resilient material preferably encircles the pin 80 as shown in FIGS. 2A & 2B. This protective loop 100 assists with holding the pin 80 in place through the substantially rigid loop 58, and prevents inadvertent contact with the pin when the tether is rapidly disconnected from the belt.

Figure 1B:
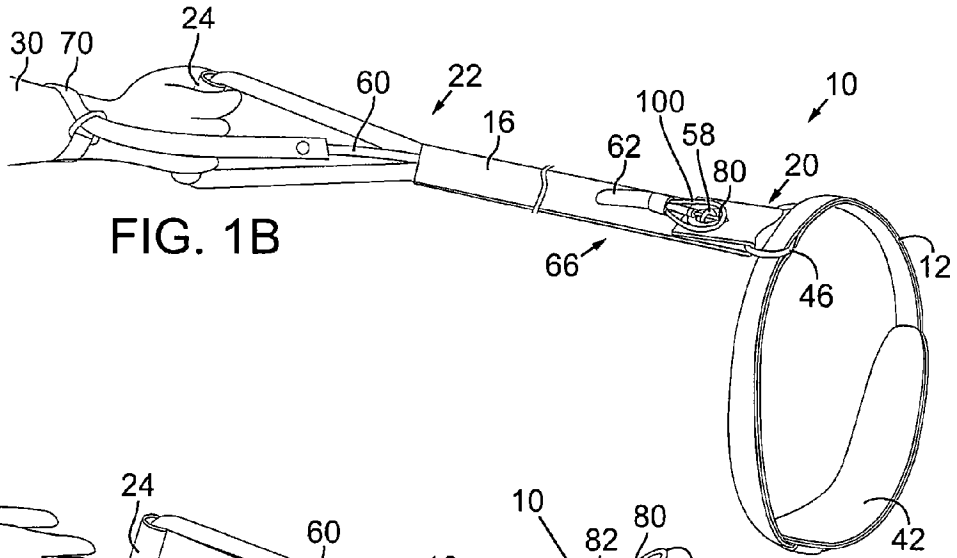
FIG. 1B is the overspeed trainer of FIG. 1 showing a possible connected configuration.
Figure 1C:
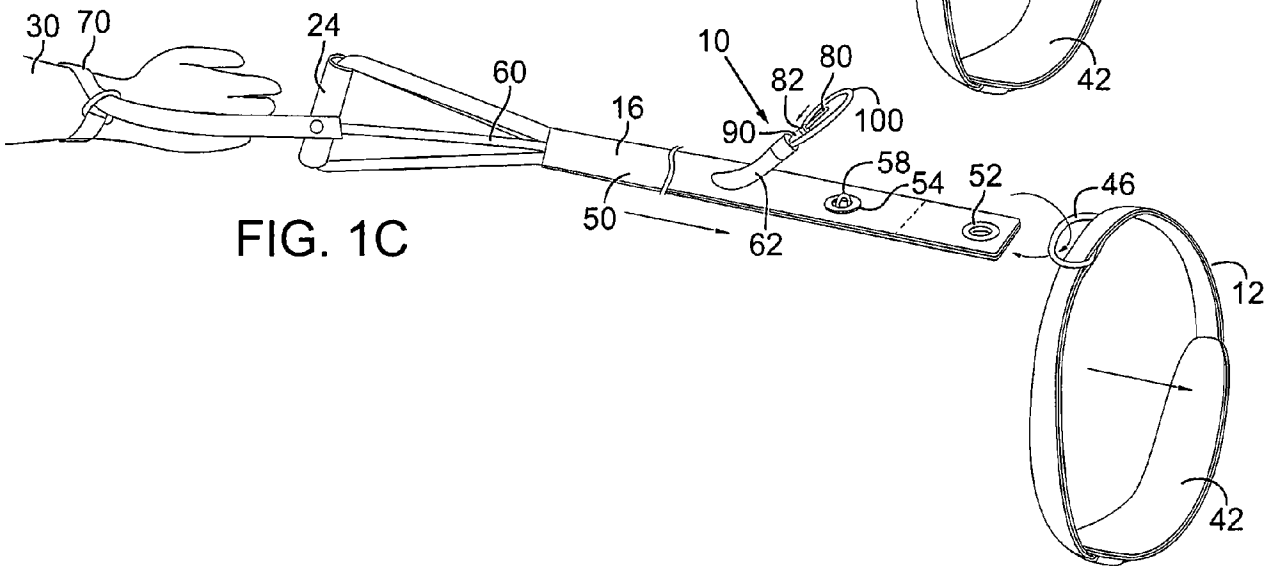
FIG. 1C is the overspeed trainer of FIG. 1 showing a possible disconnected configuration.
Figure 3:
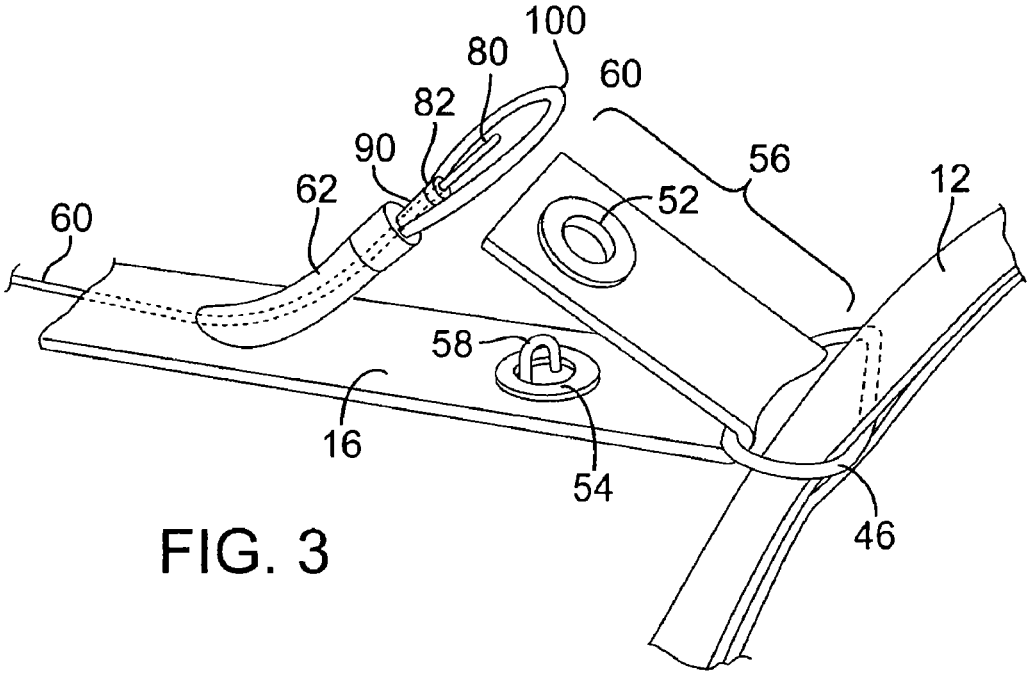
FIG. 3 is a partial isometric view of the overspeed trainer of FIG. 1 showing a possible disconnected configuration.
Figure 4:
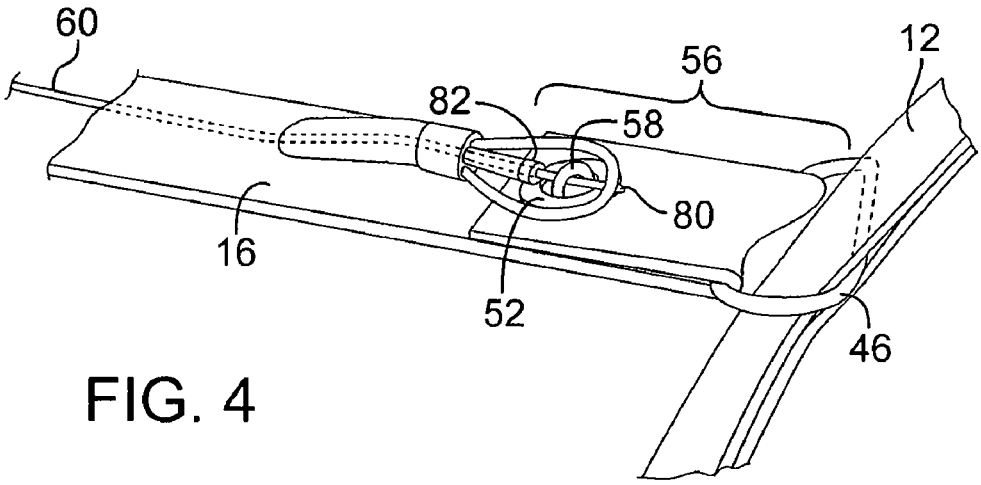
FIG. 4 is a partial isometric view of the overspeed trainer of FIG. 1 showing a possible connected configuration.

The athlete 14 is detachably secured to the tether 16 by sliding the first end 20 of the tether 16 through the D-Ring 46 on the belt 12 and aligning the two grommets 52, 54 on top of each other so that the substantially rigid loop 58 extends through both grommets 52, 54 as shown in FIG. 1B and the flap portion 56 of the tether 16 holds the D-ring 46. The pin 80 is then retracted and then released so as to position the pin 80 within the substantially rigid loop 58. The athlete is now tethered.

To release the athlete 14 from the tether 16, the second person initially grasps the handle 24 while the athlete 14 pulls the tether 16. With the wrist strap 70 encircling the second person's wrist, the second person simply lets go of the handle to release the athlete. Releasing the handle 24 causes the tension on cable 60 to increase thereby urging the pin 80 toward the disengaged position 88 (FIGS. 1A, 2C). When the pin 80 becomes disengaged from the substantially rigid loop 56, the first grommet 52 is released thereby opening the flap portion and releasing the D-Ring 46. This releases the athlete 14 from the tether 16.

Having described and illustrated the principles of our invention with reference to a preferred embodiment thereof, it will be apparent that the invention can be modified in arrangement and detail without departing from such principles. Accordingly, in view of the many possible embodiments to which the principles may be put, it should be recognized that the detailed embodiments are illustrative only and should not be taken as limiting the scope of our invention. Accordingly, we claim as our invention all such modifications as may come within the scope and spirit of the following claims and equivalents thereto.

We claim:

1. An overspeed training system for detachably tethering an athlete to one hand of a trainer, the overspeed training system comprising:

an elongate flexible tether having a first end configured to be detachably secured to a belt worn by the athlete and a second end having a handle grippable by one hand of the trainer;

a release mechanism configured to detachably connect said first end of the elongate tether from the belt, wherein said release mechanism is configured to be automatically activated upon the trainer releasing the one hand from said handle resulting in a tension on a biasing structure of the release mechanism; and wherein the first end of the elongate tether comprises a flap portion having:

a first aperture located on a first end of the flap portion;

a second aperture located on a second end of the flap portion, wherein the first and the second apertures are substantially aligned along a longitudinal length of the tether, such that the first end of the flap portion is configured to be traversed through a portion of the belt and substantially vertically realigned with the second end of the flap portion, such that the first and the second apertures are aligned along a vertical axis; and a rigid structure extending over the first aperture along the vertical axis and configured to extend through the second aperture when the first and the second ends of the flap portion are vertically aligned.

2. The overspeed training system of claim 1, wherein the tension is at least about 14 pounds of force.

3. The overspeed training system of claim 1, wherein said release mechanism includes an activation cable extending from said first end to said second end, further including:

an engaging structure for operably receiving said cable toward said first end; and a cable activation structure toward said second end for moving said cable.

4. The overspeed training system of claim 1, wherein said release mechanism includes:

a movable pin securable toward said first end of said elongate tether;

a sustainably rigid loop securable to a belt; and, said pin having an engaged position in which said substantially rigid loop is secureable to said tether through said pin, and a disengaged position in which said substantially rigid loop in released from said elongate tether.

5. The overspeed training system of claim 4, wherein the biasing structure is configured to bias said pin in said engaged position.

6. The overspeed training system of claim 4, further including a cable extending from said second end toward said first end of said elongate tether, said cable operably secured to said pin.

7. The overspeed training system of claim 6, further including a wrist strap configured to operably secure said cable to a wrist of said trainer such that when the trainer releases said handle, said pin is urged toward said disengaged position by said cable.

8. The overspeed training system of claim 4, further including a protective loop substantially encircling said pin.

9. The overspeed training system of claim 1, wherein said releasing mechanism is hook-and-loop material free.

10. The overspeed training system of claim 6, wherein said cable in operably secured within a sleeve formed within said elongate tether.

11. An overspeed training system for detachably tethering an athlete to one hand of a trainer, the overspeed training system comprising:

an elongate flexible tether having a first end configured to be detachably secured to a belt of an athlete, wherein the first end of the elongate tether comprises a flap portion having:

a first aperture located on a first end of the flap portion;

a second aperture located on a second end of the flap portion, wherein the first and the second apertures are substantially aligned along a longitudinal length of the tether, such that the first end of the flap portion is configured to be traversed through a portion of said belt and substantially vertically realigned with the second end of the flap portion, such that the first and the second apertures are aligned along a vertical axis; and a rigid structure extending over the first aperture along the vertical axis and configured to extend through the second aperture when the first and the second ends of the flap portion are vertically aligned;

a handle proximate to a second end of the tether, said handle grippable by one hand of a trainer; and a release mechanism configured to detachably connect said first end of the elongate tether from said belt, wherein the release mechanism comprises:

a pin having an engaged position in which the pin traverses through the rigid structure in a direction along the longitudinal length of the tether configured to retain the first and the second apertures in alignment along the vertical axis;

wherein said release mechanism is configured to be automatically activated upon a trainer releasing one hand from said handle, thereby permitting the pin to move to a disengaged position in which the first and second apertures are no longer retained in vertical alignment and permitting said belt to separate from the first end of the flap portion.

12. The overspeed training system of claim 11, wherein the release mechanism comprises a biasing structure configured to bias said pin in said engaged position and further configured such that a force from a person releasing the handle automatically results in a tension on a biasing structure to move pin to the disengaged position.

13. The overspeed training system of claim 12, wherein the tension is at least about 14 pounds of force.

14. The overspeed training system of claim 11, wherein said release mechanism includes an activation cable extending from said one end to said opposite end, further including:

an engaging structure for operably receiving said cable toward said first end; and a cable activation structure toward said second end for moving said cable.

15. The overspeed training system of claim 11, further including a cable and a wrist strap configured to operably secure said cable to a wrist of a trainer such that when the trainer releases said handle, said pin is urged toward said disengaged position by said cable.

16. The overspeed training system of claim 15, further including a protective loop substantially encircling said pin.

17. The overspeed training system of claim 11, wherein said releasing mechanism is hook-and-loop material free.

18. The overspeed training system of claim 15, wherein said cable is operably secured within a sleeve formed within said elongate tether.

19. The overspeed training system of claim 11, wherein the tension is about 14 to about 20 pounds of force.

* * * * *